US007100520B2

(12) United States Patent
Abe et al.

(10) Patent No.: US 7,100,520 B2
(45) Date of Patent: Sep. 5, 2006

(54) THEFT-PREVENTION INK PACK DEVICE, AND TREASURE SAFE HAVING THE SAME

(75) Inventors: Tsuyoshi Abe, Kawasaki (JP); Hayato Minamishin, Kawasaki (JP); Masato Koike, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/614,082

(22) Filed: Jul. 8, 2003

(65) Prior Publication Data

US 2004/0007165 A1 Jan. 15, 2004

Related U.S. Application Data

(63) Continuation of application No. PCT/JP01/00363, filed on Jan. 19, 2001.

(51) Int. Cl.
*E05G 1/00* (2006.01)

(52) U.S. Cl. ..... 109/25; 109/21; 109/29

(58) Field of Classification Search ..... 109/25, 109/21, 20, 29

See application file for complete search history.

(56) References Cited

U.S. PATENT DOCUMENTS

| | | | | | |
|---|---|---|---|---|---|
| 3,344,757 | A | * | 10/1967 | Touyet | 109/25 |
| 4,202,445 | A | | 5/1980 | Porter | 206/37 |
| 4,607,579 | A | * | 8/1986 | Stenild | 109/25 |
| 5,208,085 | A | * | 5/1993 | Pace | 428/43 |
| 5,388,433 | A | * | 2/1995 | Andersson et al. | 70/57.1 |
| 5,406,896 | A | * | 4/1995 | Jacobson | 109/29 |
| 5,410,295 | A | * | 4/1995 | Van Lint | 340/568.7 |
| 5,598,793 | A | * | 2/1997 | Lopez, Jr. | 109/25 |
| 6,164,770 | A | * | 12/2000 | Takata | 347/86 |
| 6,227,662 | B1 | * | 5/2001 | Takata | 347/86 |
| 6,292,101 | B1 | * | 9/2001 | Stoltz et al. | 340/572.8 |
| 6,564,726 | B1 | * | 5/2003 | Lindskog | 109/25 |

FOREIGN PATENT DOCUMENTS

| | | |
|---|---|---|
| JP | 4-98387 | 3/1992 |
| JP | 6-108741 | 4/1994 |
| JP | 7-303512 | 11/1995 |
| JP | 8-086149 | 4/1996 |
| JP | 2000-320248 | 11/2000 |
| JP | 2000-322625 | 11/2000 |
| WO | 99-60502 | 11/1999 |

* cited by examiner

OTHER PUBLICATIONS

Notification of First Office Action for corresponding Chinese Application No. 01822133.5 mailed Sep. 3, 2004.

*Primary Examiner*—Suzanne Dino Barrett
(74) *Attorney, Agent, or Firm*—Staas & Halsey LLP

(57) ABSTRACT

A theft-prevention ink pack device is provided, comprising a support member (70) having support lugs (73*a*, 74*a*, 75*a*, 75*b*) within a case (130) having ink spouts (66) and knife edges (69), a tray member (80) supported by the lugs (73*a*, etc.), spaced from the knife edges (69), an ink pack (90) placed on the tray member (80) and having a bag (92) containing ink (91), a pressboard (100) positioned behind the ink pack (90), and conical compression coil springs (120, 121) for pushing the pressboard (100). When the support member (70) is moved as it is pulled, the support provided by the support lugs (73*a*, etc.) of the tray member (80) is cancelled to cause the tray member (80) to fall down and the ink pack (90) is broken by the knife edges (69) and urged under pressure by the spring forces of the springs (120, 121) via the pressboard (100) to cause the ink to spurt through the ink spouts (66).

10 Claims, 8 Drawing Sheets

THEFT-PREVENTION INK PACK DEVICE, AND TREASURE SAFE HAVING THE SAME

CROSS-REFERENCE TO RELATED APPLICATIONS

This application is a continuation of copending international application No. PCT/JP01/00363, filed Jan. 19, 2001.

TECHNICAL FIELD

The present invention generally relates to a theft-prevention ink pack device and a treasure safe implementing this theft-prevention ink pack device. Particularly, the present invention relates to a theft-prevention ink pack device implemented in a treasure safe that keeps valuables such as bank notes so that when the treasure safe is opened by improper means the ink pack device shoots out ink and marks the valuables kept inside. Herein, the treasure safe includes any type of accommodating means for keeping valuables, such as a portable case or a built-in vault.

BACKGROUND ART

In a treasure safe that keeps valuables such as bank notes and cash vouchers, devices for preventing theft by discouraging a break-in are implemented.

An example of a theft-prevention device is a device for causing a security alarm buzzer to go off when the treasure safe is opened improperly. However, this device is not very effective for preventing theft since the security alarm sound is unable to specify what is being stolen. Also, a battery is used as the power source for the alarm buzzer so that if the battery set to the device is dead, the alarm will not go off even when the treasure safe is opened improperly.

Another example of a theft-prevention device is a device that taints the notes with a special kind of ink so that they will be invalid as currency.

In Japanese Patent Laid-Open Publication No. 6-108741, a device including an ink tank, a spraying pipe, a thermal line, and a battery that are mounted in the device is disclosed. According to this prior art invention, when a treasure safe is opened improperly, electricity passes through the thermal line so that it generates heat. This in turn causes the spraying pipe to melt and thus, the ink spills out due to its own weight and taints the notes kept in the treasure safe. However, in this device, if the battery set in the device is dead, the thermal line will not generate heat and the ink will not come out even when the treasure safe is improperly opened.

In Japanese Patent Laid-Open Publication No. 4-98387, a device including an ink bag and an oscillation rod implementing a needle is disclosed, wherein the ink bag is mounted under a top board of the treasure safe and the oscillation rod is placed under the ink bag. According to this prior art invention, the oscillation rod is supported by a spring that applies a force to this oscillation rod so that when the treasure safe is improperly opened, the oscillation rod is moved by means of the spring force. As a result, the needle makes a hole in the ink bag, causing the ink to spill out due to its own weight and taint the notes kept in the treasure safe. In this device, the life of a battery is not a problem because a battery is not used. However, since the ink spills out only from its own weight, the ink cannot be sprayed with much force. Thereby, the notes will not be severely tainted and there may even be notes that have not been marked by the ink.

Also, neither the device disclosed in Japanese Patent Laid-Open Publication No. 4-98387, nor the device disclosed in Japanese Patent Laid-Open Publication No. 6-108741, is arranged into a module structure. Therefore, the assembling of the treasure safe becomes complicated and the size of the treasure safe has to be made larger.

DISCLOSURE OF THE INVENTION

The present invention has been developed in response to the above problems of the related art and its overall object is to provide a highly reliable theft-prevention ink pack device implemented in a treasure safe that keeps valuables such as bank notes, wherein an operation of marking the notes kept in the treasure safe with ink to identify the notes as stolen currency and an operation of severely tainting all of the notes kept in the treasure safe with the ink are performed with great accuracy.

To this end, the present invention provides a theft-prevention ink pack device including:

an ink pack, which is a bag containing ink, implemented inside a case having a front board on which an ink spout is formed;

a spring that urges the ink pack and a knife edge toward each other and applies pressure to the ink pack;

the knife edge for tearing open the ink pack; and an engaging structure that is engaged to support a state in which the ink pack and the knife edge are spaced apart from each other, and is disengaged upon being affected by an outer force; wherein when the engagement structure is disengaged, the ink pack and the knife edge are moved toward each other by the spring force of the spring so that the ink pack is torn by the edge, and pressure is applied to the ink pack, resulting in the ink shooting out from the ink spout.

Since the force for tearing the ink pack and the force for the ink to shoot out are both provided by the spring, the reliability of the operation is higher and the fabrication cost is lower compared to a structure in which electricity is used. Also, since the force of the spring is used to spray the ink, the ink can be sprayed with significant force regardless of the position of the theft-prevention ink pack device. That is, there will be greater flexibility in the positioning of the ink pack device and the ink shooting performance can be improved. Further, since the ink is shot out with sufficient force, all the notes kept in the treasure safe will be severely tainted to the extent that they will be worthless.

Also, since the theft-prevention ink pack device is made into a unit structure, the treasure safe can be easily assembled and its size can be made smaller.

It is a further object of the present invention to provide a theft-prevention ink pack device that is arranged to shoot out practically all of the ink in the ink pack.

To this end, the ink pack device according to the present invention is arranged to press the back side of the ink pack with a pressboard.

The pressboard presses the entire ink pack so that practically all the ink in the ink pack is shot out.

It is also an object of the present invention to provide a treasure safe in which an operation of marking the contents of the treasure safe with ink when the treasure safe is improperly opened so as to identify the contents as stolen items is performed reliably.

To this end, the treasure safe according to the present invention includes:

a box structure that implements the theft-prevention ink pack device as claimed in any one of claims 1 through 6 and includes;

a door that opens by rotating;

a locking device that locks the door and is unlocked when the door is opened;

a connecting structure that connects the door to the theft-prevention ink pack device; and a disconnecting structure that disconnects the connection made by the connecting structure when the locking of the door by the locking structure is released.

Since the ink pack device as claimed in any one of claims 1 through 6 has good operational reliability and good ink shooting capabilities, all the notes kept in the treasure safe can be severely tainted to an extent that the notes become worthless as currency. Also, since the theft-prevention ink pack device is made into a unit structure, the treasure safe can be easily assembled and its size can be reduced.

BEST MODE FOR CARRYING OUT THE INVENTION

In the following, preferred embodiments of the present invention are described with reference to the accompanying drawings.

Figure 1:
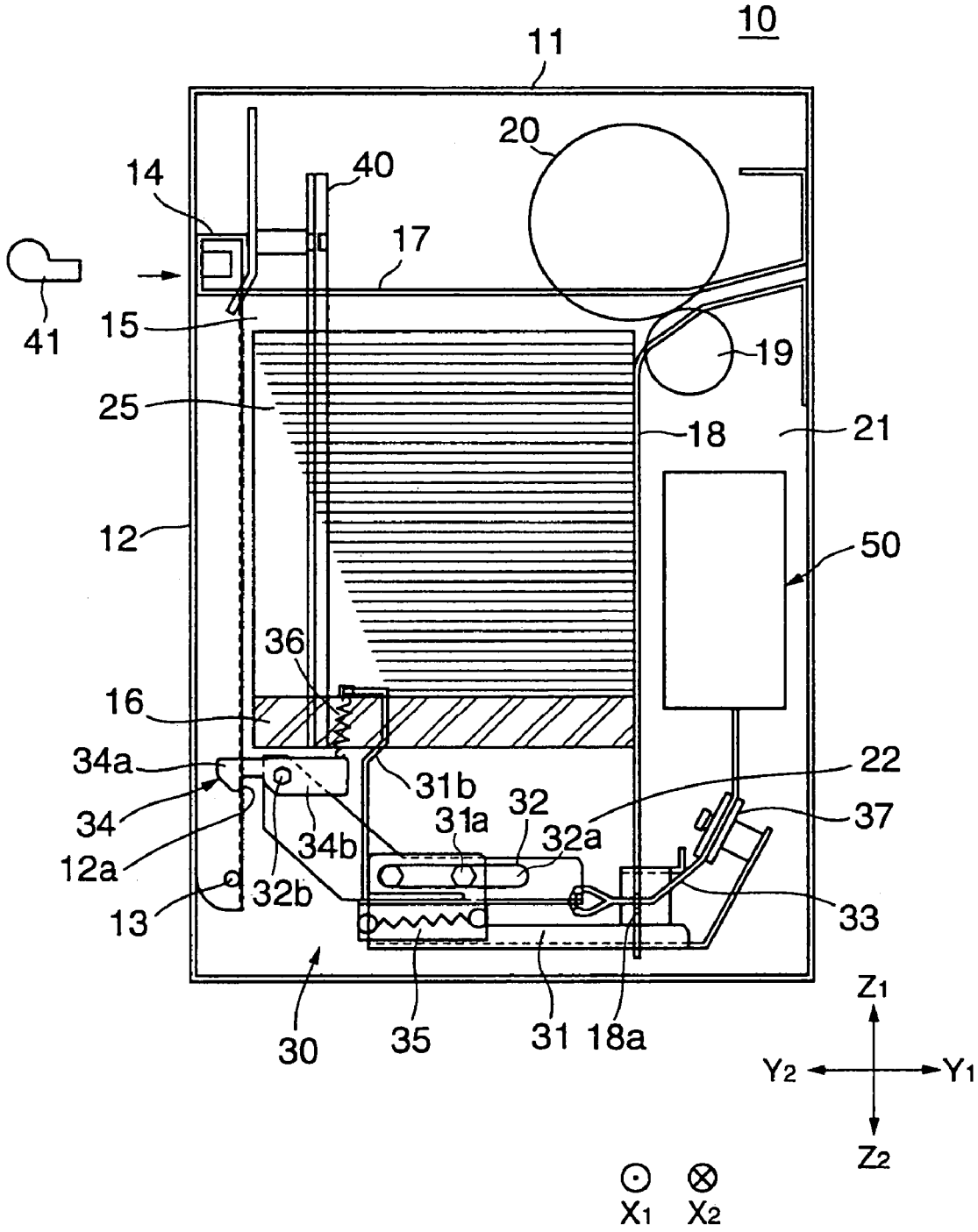
FIG. 1 is a diagram showing an internal structure of a treasure safe according to an embodiment of the present invention.

FIG. 1 shows an internal structure of a cash box 10 according to an embodiment of the present invention. The cash box 10 is fixed to an ATM (automated teller machine) and includes a box structure 11, and a door 12 placed at the front side of the box structure 11. In this drawing, directions X1–X2 represent directions along the width of the cash box 10, directions Y1–Y2 represent directions along the depth of the cash box 10, and directions Z1–Z2 represent directions along the height of the cash box 10. The lower side of the door 12 is supported by an axis 13 and the door 12 is opened by pulling the upper side of the door 12 in the Y2 direction, the resulting state being shown in FIG. 2. The door 12 has a locking device 14 mounted on its top portion.

The cash box 10 has a bank note storage room 15 for storing the accumulated stack of bank notes. The bank note storage room 15 is made of a bottom board 16, a top board 17, a mesh-structured back board 18, and two side boards (not shown). At a corner portion formed by the top board 17 and the back board 18 of the bank note storage room 15, bank note sending rollers 19 and 20 are implemented. The numeral 25 represents the accumulated stack of bank notes stored in the bank note storage room 15.

In a space 21 created behind the bank note storage room 15 within the cash box 10, a theft-prevention ink pack device 50 is implemented in an upright position.

Also, in a space 22 created below the bank note storage room 15 within the cash box 10, a connecting structure 30 is implemented.

The connecting structure 30 includes a bracket 31, a sliding bracket 32, a cord 33, and a hook member 34.

The bracket 31 extends along the Y1–Y2 directions and is fixed to the box structure 11. The sliding bracket 32 has an elongated hole 32*a* that is fit to two pins 31*a* of the bracket 31 and is supported by the bracket 31 so as to be able to slide in the Y1–Y2 directions. The sliding bracket 32 is also pulled in the Y1 direction by a pulling coil spring 35.

The cord 33 connects the sliding bracket 32 to the theft-prevention ink pack device 50. In this connection, the cord 33 passes through a hole 18*a* in the back board 18 and is led to a pulley 37 at the end of the bracket 31 on the Y1 direction side.

The hook member 34 is supported by an axis 32*b* at the end of the sliding bracket 32 on the Y2 direction side so as to rotate around this axis 32*b*. The hook member 34 includes a hook portion 34*a* that extends in the Y2 direction from the axis 32*b* and an arm portion 34*b* that extends in the Y1 direction from the axis 32*b*. The hook portion 34*a* engages an engaged portion 12*a* formed on the inner side of the door 12. The arm portion 34*b* is connected to an upright lug portion 31*b* of the sliding bracket 32 via a coil spring 36. The coil spring 36 urges the hook member 34 to rotate in the counterclockwise direction, that is, the direction in which the hook portion 34*a* engages the engaged portion 12*a* formed on the inner side of the door 12.

Also, with regard to the locking device 14, a lever 40 that slides in the Z1–Z2 directions is provided. The lower end of the lever 40 faces the arm portion 34*b* of the hook member 34. When a key 41 is inserted into the locking device 14 and turned to unlock the door 12, the lever 40 slides in the Z2 direction and pushes the arm portion 34*b* so that the hook member 34 rotates in the clockwise direction and is disengaged from the engaged portion 12*a* on the inner side of the door 12.

Figure 2:
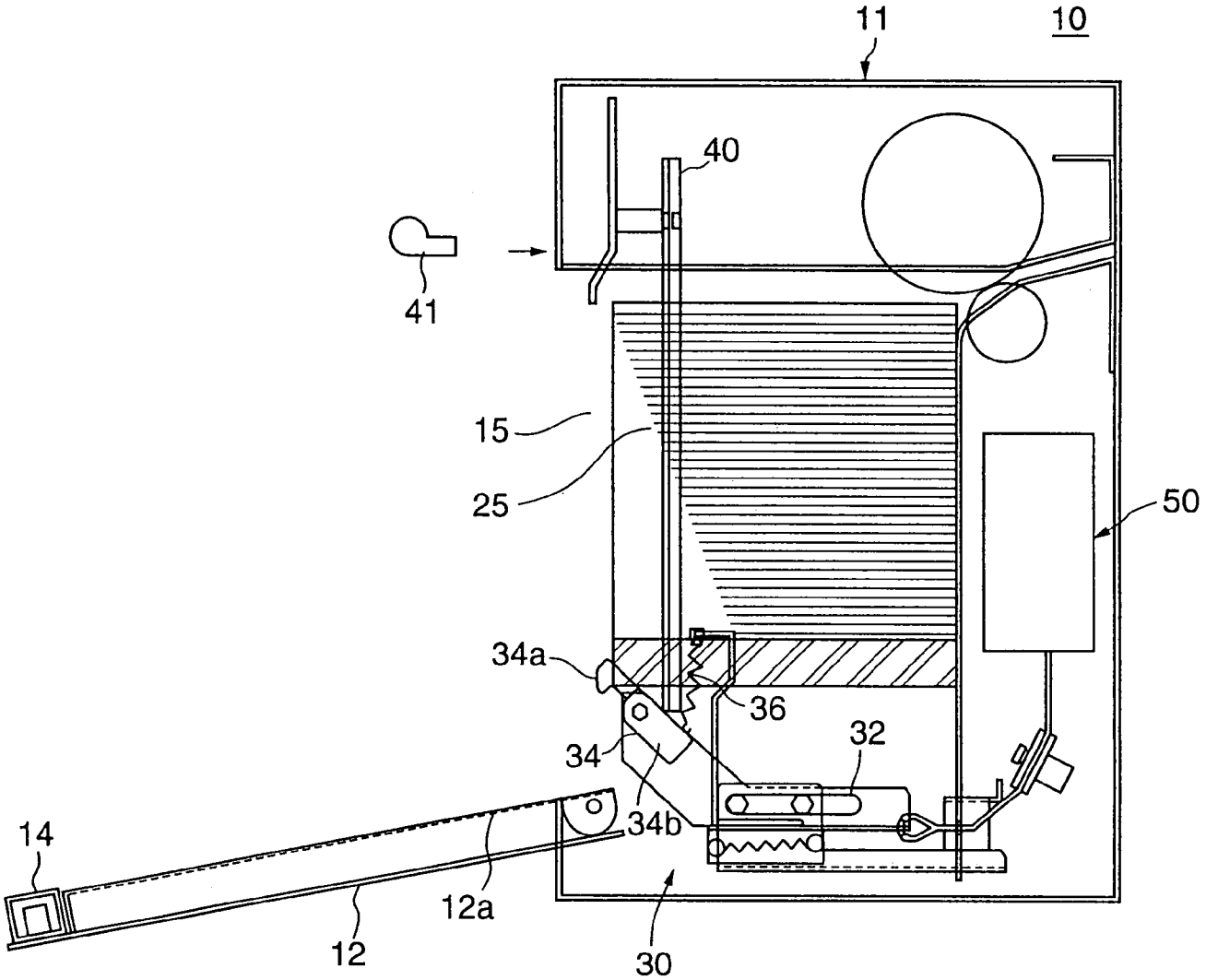
FIG. 2 is a diagram showing a state of the treasure safe of FIG. 1 when its door is opened properly.

FIG. 2 shows the state of the cash box 10 when the door 12 is opened properly. When the locking device is unlocked using the key 41, the lever 40 slides in the Z2 direction, the hook member 34 rotates clockwise, the hook portion 34*a* is disengaged from the engaged portion 12*a*, and the sliding bracket 32 is disconnected from the door 12. Thus, the sliding bracket 32 will not be pulled in the process of pulling the door 12 forward to open the cash box 10 and in turn, the cord 33 will not be pulled. Thereby, the theft-prevention ink pack device will not activate in this case.

Figure 3:
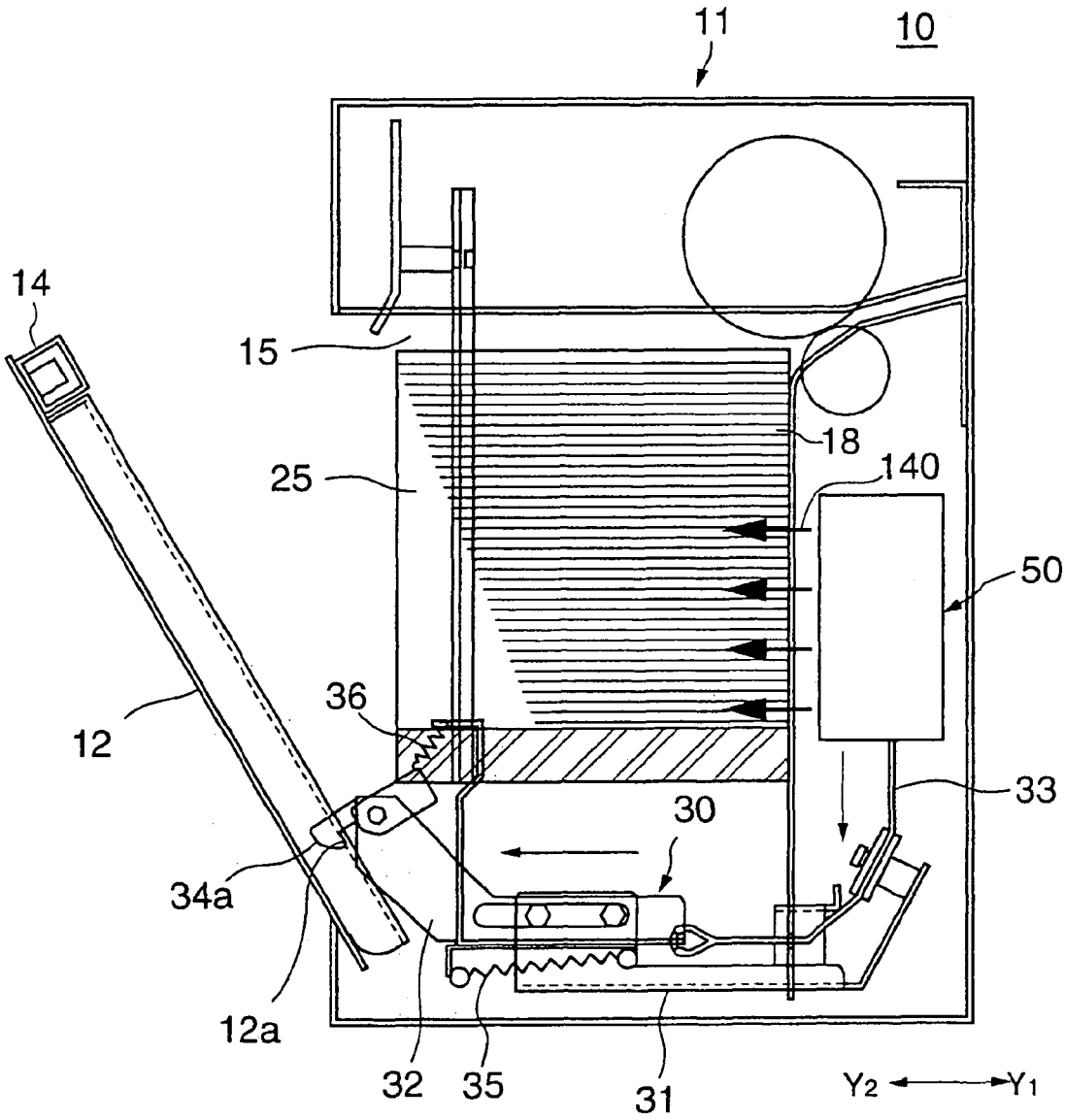
FIG. 3 is a diagram showing a state of the treasure safe of FIG. 1 halfway through a process of being opened improperly.

On the other hand, FIG. 3 shows the state of the cash box 10 when the door 12 is opened improperly. 'When the door is opened improperly' refers to a case in which the key 41 is not used to open the door 12 such as when a burglar pulls open the door 12 by breaking the locking device 14.

In this case, the hook portion 34*a* still engages the engaged portion 12*a* and thus, the sliding bracket 32 is connected to the door 12. Thereby, when the door 12 is pulled open, the sliding bracket 32 is also pulled so that it moves in the Y2 direction. In turn, the cord 33 is pulled and the theft-prevention ink pack device 50 starts operating. In the operation of the theft-prevention ink pack device 50, special ink is sprayed with significant force in the Y2 direction as indicated by arrows 140. The ink penetrates through the mesh-structured back board 18 and is shot into the bank note storage room 15. Thus, all of the notes 25 stored in the note storage room 15 will be severely tainted by the special ink so that the notes 25 will be invalidated.

Note that the sliding bracket 32 is pulled in the Y1 direction by the pulling coil spring 35. This arrangement prevents the sliding bracket 32 from moving in the Y2 direction when the cash box 10 is mistakenly dropped or when a strong force is applied to the cash box 10.

Also, the hook member 34 is urged in the counterclockwise direction by the coil spring 36. Thus, even when a burglar applies a strong force to the cash box 10 to disengage the engagement between the hook portion 34*a* and the engaged portion 12*a*, the hook portion 34*a* will not disengage from the engaged portion 12*a*.

In the following, the theft-prevention ink pack device 50 according to an embodiment of the present invention will be described with reference to FIGS. 4, 5A, 5B, and 6.

The theft-prevention ink pack device 50 has a rectangular box shaped configuration, and is made into a unit structure. Also, the theft-prevention ink pack device 50 cannot be disassembled and all its operations are realized mechanically through the use of a spring force.

Figure 4:
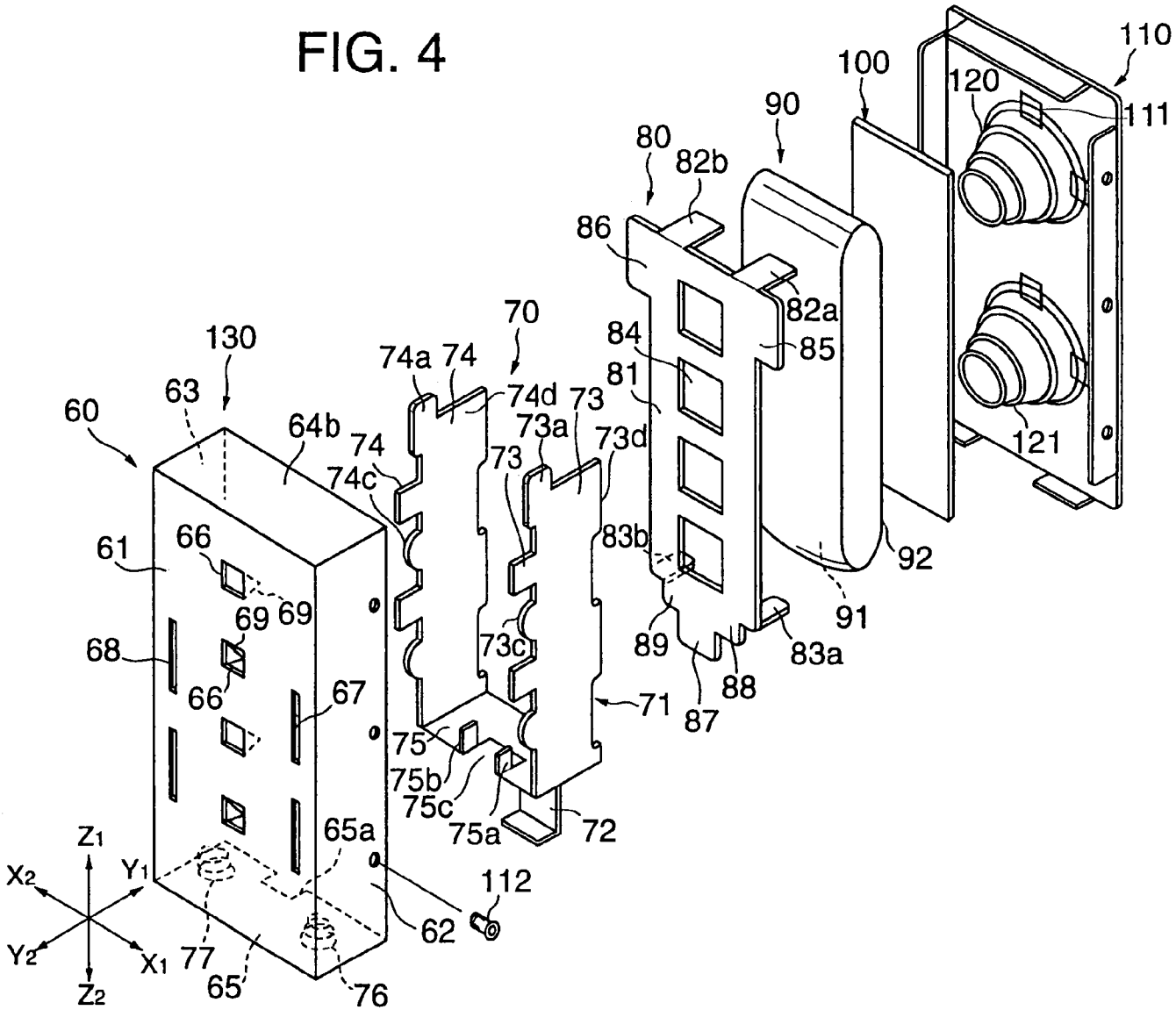
FIG. 4 is a perspective view diagram showing the component parts of the theft-prevention ink pack device according to an embodiment of the present invention.
Figure 5A:
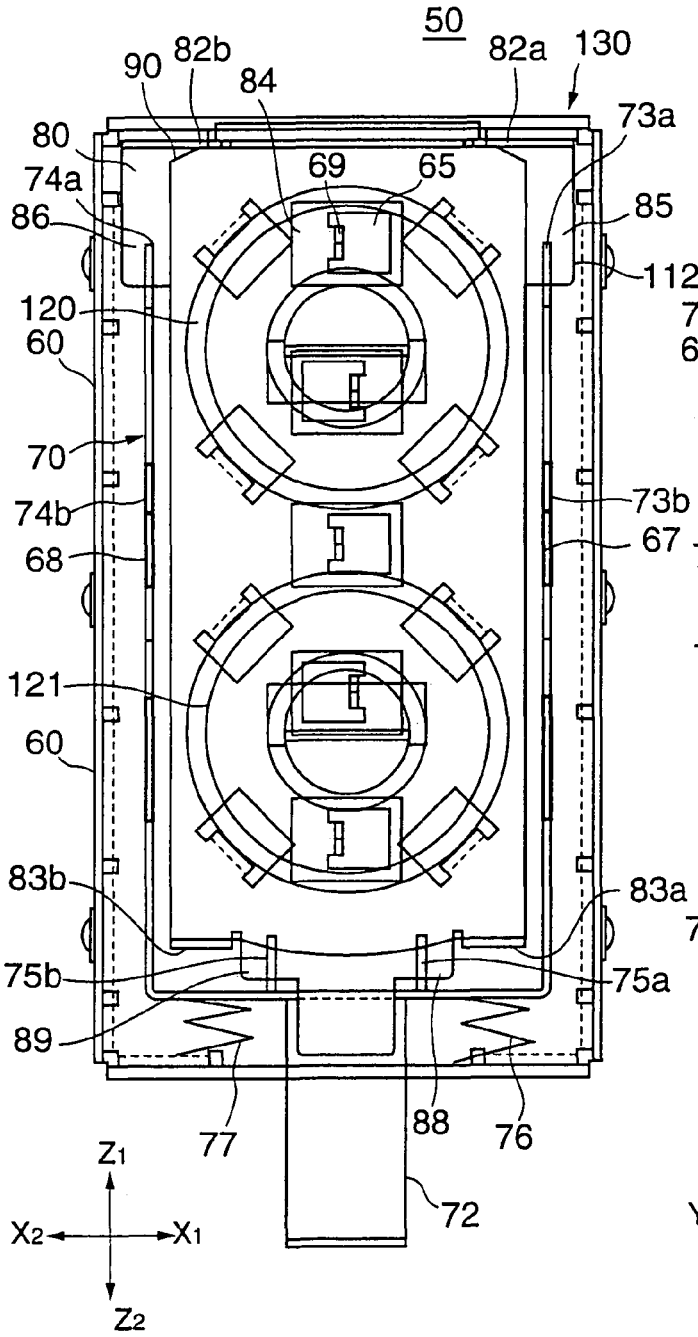
FIGS. 5A and 5B are diagrams showing an internal structure of a theft-prevention ink pack device according to an embodiment of the present invention.
Figure 5B:
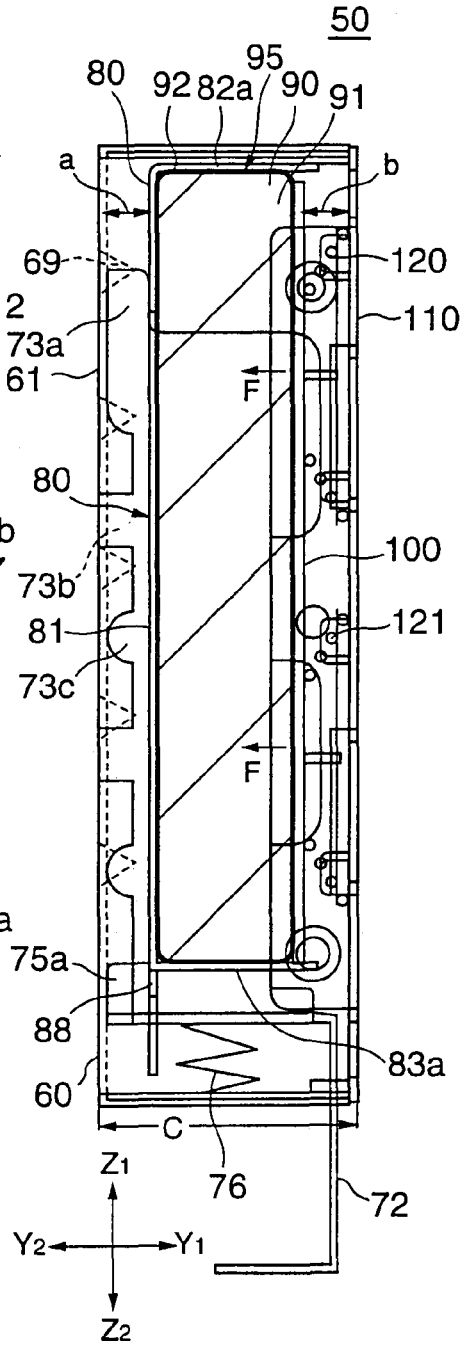

FIGS. 4, 5A, 5B, and 6 show the theft-prevention ink pack device 50 in a position that is identical to the position of the theft-prevention ink pack device 50 shown in FIG. 1, respectively. That is, the directions X1–X2, Y1–Y2, and Z1–Z2 in FIGS. 4, 5A, and 5B are identical to the directions X1–X2, Y1–Y2, and Z1–Z2 in FIG. 1. Thus, the X1–X2 directions represent the width directions of the theft-prevention ink pack device 50, the Z1–Z2 directions represent the height directions (lengthwise directions) of the theft-prevention ink pack device 50, and the directions Y1–Y2 represent the depth directions of the theft-prevention ink pack device 50.

The theft-prevention ink pack device 50 includes a case main body 60, a support member 70, a tray member 80, an ink pack 90, a press board 100, a back lid member 110, and two conical compression coil springs 120 and 121, wherein the support member 70, the tray member 80, the ink pack 90, the press board 100, the two conical compression coil springs 120 and 121, and compression coil springs 76 and 77 are mounted inside a rectangular box-shaped case 130 formed by the case main body 60 and the back lid member 110.

The main body 60 has a box structure that includes a front board portion 61, and surrounding side board portions 62–65. Along the center portion of the front board portion 61, a plurality of ink spouts 66 are formed in alignment with respect to the Y1–Y2 directions. Also, at the side portions of the front board 61 in each of the directions X1 and X2, a plurality of slit-shaped guide holes 67 and 68 are formed along the Y1–Y2 directions. At a rim of each of the ink spouts 66, a triangular-shaped knife edge 69 is formed to protrude inward with respect to the main body 60, that is, in the Y1 direction. The knife edge 69 in each of a given set of two adjacent ink spouts 66 protrudes from a rim positioned opposite the other with respect to the X1–X2 directions.

This knife edge 69 is pressed and formed in the process of forming the ink spouts 66 on the front board portion 61. Thus, the knife edge 69 is a part of the main body 60 as opposed to being an independent element. In this way, the number of parts making up the theft-prevention ink pack device 50 can be reduced. Also, since the knife edge 69 is formed on the front board portion 61, the dimensions of the theft-prevention ink pack device 50 can be reduced in the Y1–Y2 directions. Also, since the knife edge 69 is positioned at the rim of the ink spout 66, the location of the hole made in the ink pack 90 when it is torn faces the ink spout 66 so that the ink passes through the ink spout and shoots out with ease.

At the inner side of the side board portion 65, compression coil springs 76 and 77 are implemented.

The support member 70 is a Y-shaped structure, and it includes a U-shaped frame portion 71 and an arm portion 72 that extends in the Z2 direction from the frame portion 71. The frame portion 71 has a pair of side board portions 73 and 74 extending in the Z1–Z2 directions, and a link board portion 75 that extends along the X1–X2 directions and links the ends of the pair of side board portions 73 and 74 on the Z2 direction side. Further, support lugs 73*a* and 74*a* are formed at the ends of the side board portions 73 and 74, respectively, on the Z1 direction side. The link board portion 75 has support lugs 75*a* and 75*b* that are bent in the Z1 direction.

As shown in FIG. 5A, the support lugs 73*a*, 74*a*, 75*a* and 75*b* are spread in four different positions.

Also, guide lugs 73*b* and 74*b*, and slide shoes 73*c* and 74*c* are formed at the ends of the side board portions 73 and 74, respectively, on the Y2 direction side. At the ends of the side board portions 73 and 74 in the Y1 direction, lugs 73*d* and 74*d* are respectively formed.

The link board 75 has a cut opening portion 75*c* formed on the Y2 direction side. The support lugs 75*a* and 75*b* face the cut opening portion 75.

The arm portion 72 extends in the Z2 direction from the link board 75.

The above described support member 70 is arranged inside the case main body 60 of the case 130, wherein the guide lugs 73*b* and 74*b* are fit into the guide holes 67 and 68, respectively, and the slide shoes 73*c* and 74*c* touch the inner surface of the front board portion 61. The support member 70 is urged to move in the Z1 direction by the spring force of the compression coil springs 76 and 77. The arm portion 72 goes through a cut opening portion 65*a* of the side board portion 65 and extends in the Z2 direction from the case main body 60.

The tray member 80 has a flat main body portion 81, and arm portions 82*a*, 82*b*, 83*a*, and 83*b*, which are portions bent to extend in the Y1 direction from the ends of the main body 81 in each of the directions Z1 and Z2.

The size of the tray main body 81 is arranged so that it will be able to fit into the U-shaped frame portion 71, and on this main body 81, window openings 84 corresponding to the ink spouts 66 arranged to be larger than the ink spouts 66 are formed. At the end portion of the main body 81 in the Z1 direction, lug portions 85 and 86 protruding in the X1 direction and X2 direction, respectively, are formed. Also, a protruding portion 87 protruding in the Z2 direction is formed at the end of the main body 81 in the Z2 direction.

Figure 6:
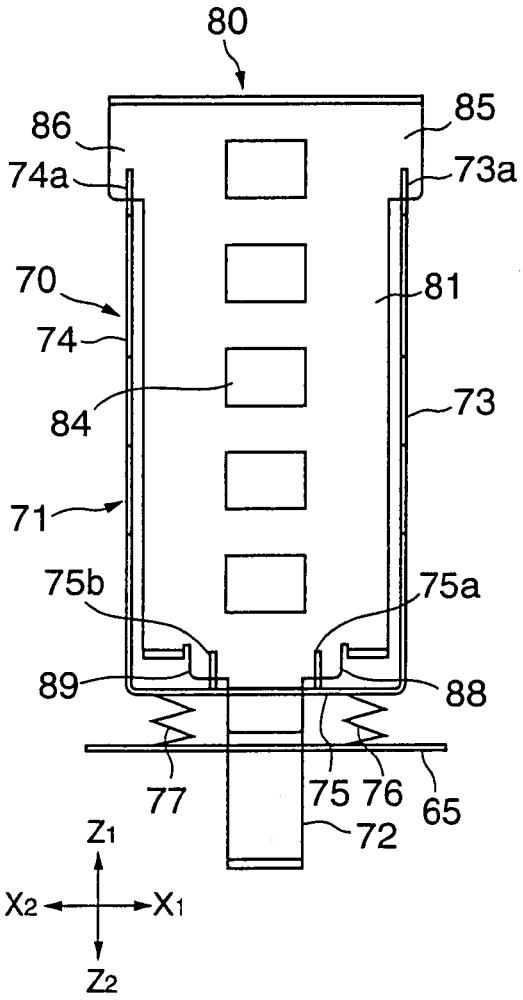
FIG. 6 is a diagram showing a relationship between a tray member and a support member.

Referring also to FIG. 6, the tray member 80 is fit into the U-shaped frame portion 71 so that the lug portions 85 and 86 are supported by the support lugs 73*a* and 74*a*, and side portions 88 and 89 of the protruding portion 87 on the Z2 direction side of the tray main body 81 are supported by the support lugs 75*a* and 75*b*, respectively. Further, the tray member 80 is placed at a distance 'a' away in the Y1 direction from the inner surface of the front board portion 61 of the case main body 60 so that it will not touch the knife edges 69. The protruding portion 87 goes through the cut opening portion 75*c* and closes in on the inner surface of the side board portion 65 of the case main body 60.

The support member 70 and the tray member 80 form a box structure with the tray member 80 as the bottom of the box, and this box structure functions as an ink pack accommodating portion 95 for holding the ink pack 90.

The ink pack 90 is a bag 92 made of synthetic resin that contains ink 91, and its size is arranged according to the size of the ink pack accommodating portion 95. The ink 91 needs to have permeable and diffusible characteristics. Also the ink 91 may be a special kind of ink that contains a magnetic powder substance. The ink pack 90 is contained in the ink pack accommodating portion 95.

The pressboard 100 is a flat board that is arranged to fit into the U-shaped frame portion 71. The position of the pressboard 100 is controlled in the X1–X2 directions and Z1–Z2 directions by the lugs 73*d* and 74*d*, and the arm portions 82*a*, 82*b*, 83*a*, and 83*b*, respectively. Further, the surface of the pressboard 100 comes into contact with the ink pack 90 on the Y1 direction side.

The two conical compression coil springs 120 and 121, aligned in the Z1–Z2 directions, are attached to the back lid member 110 by lugs 111 formed by cutting and bending portions of the back lid member 110.

The back lid member 110 covers the back opening of the case main body 60 with the conical compression coil springs 120 and 121 in a compressed state. The back lid member 110 is fixed to the case main body 60 with a plurality of rivets 112.

The compressed conical compression coil springs 120 and 121 press the pressboard 100 at two places with a strong force F in the Y2 direction.

The ink pack 90 is pressed toward the Y2 direction by the pressboard 100, which is pressured by the spring force of the conical compression coil springs 120 and 121. Thus, the ink pack 90 placed between the pressboard 100 and the tray member 80 is in a compressed state but is distanced away from the knife edges 69. For the ink pack 90, the tray member 80 is the floor and the front board portion 61 is the ground.

The support member 70 is pressed toward the Y2 direction via the tray member 80, and the guide lugs 73*b* and 74*b* are securely fit into the guide holes 67 and 68, respectively. In this way, the position of the support member 70 within the case 130 is controlled so that it will not move unnecessarily. Specifically, with respect to the Z2 direction, the support member 70 is prevented from moving by the spring force of the compression coil springs 76 and 77. By preventing the support member 70 from moving, the ink pack 90 can be prevented from moving unnecessarily.

Also, since the support member 70 is prevented from moving unnecessarily in the Z2 direction by means of the spring force of the compression coil springs 76 and 77 as described above, the theft-prevention ink pack device 50 can be prevented from malfunctioning even when a strong force is exerted on the theft-prevention ink pack device 50.

Further, since the conical compression coil springs 120 and 121 do not come into direct contact with the ink pack 90, the bag can be prevented from being scratched and damaged unnecessarily.

Herein, each of the conical compression coil springs 120 and 121 is arranged so that the upper (extended) coil portion of the conical structure can recede into the lower coil portion when it is compressed. Thus, the springs 120 and 121 can be flattened down to a thickness equivalent to the diameter of the wire making up the conical compression coil springs 120 and 121. In this way, the distance 'b' between the back lid member 110 and the pressboard 100 can be reduced and the dimension 'c' of the theft-prevention ink pack device 50 in the Y1–Y2 directions can be reduced.

In the above, the configuration of the theft-prevention ink pack device 50 has been described.

In the following, the operation of the theft-prevention ink pack device 50 having the above configuration will be described.

Given that the theft-prevention ink pack device 50 is in the state shown in FIGS. 5A and 5B, the support member 70 will be moved toward the Z2 direction when the arm portion 72 is pulled in the Z2 direction. On the other hand, since the protruding portion 87 is inserted in the cut opening portion 65*a* of the side board portion 65 of the case main body 60, the tray member 80 is prevented from moving in the Z2 direction. The ink pack 90 and the pressboard 100 also remain in their original positions.

Figure 7:
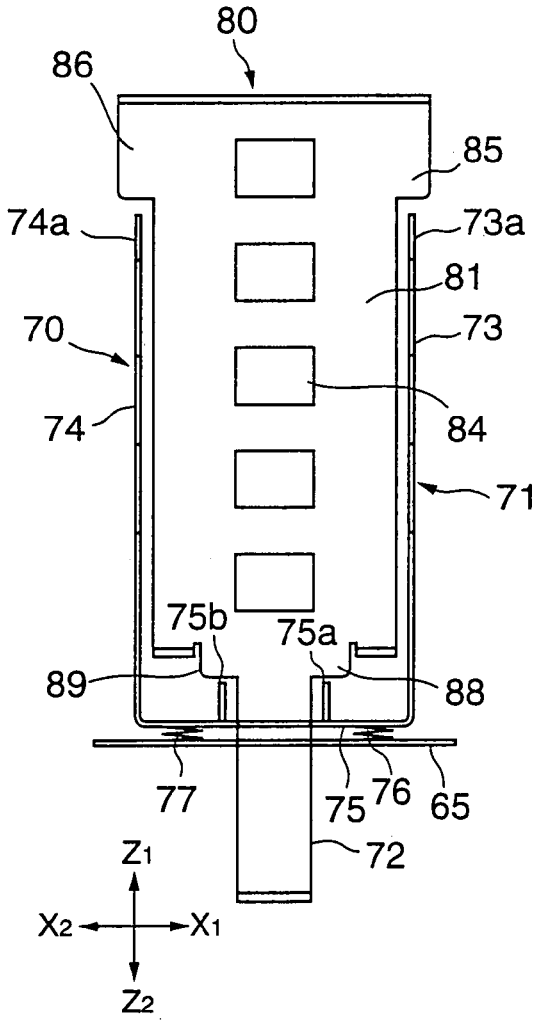
FIG. 7 is a diagram showing a state in which the support member is moved and the tray member is released from the support provided by the support member.
Figure 8:
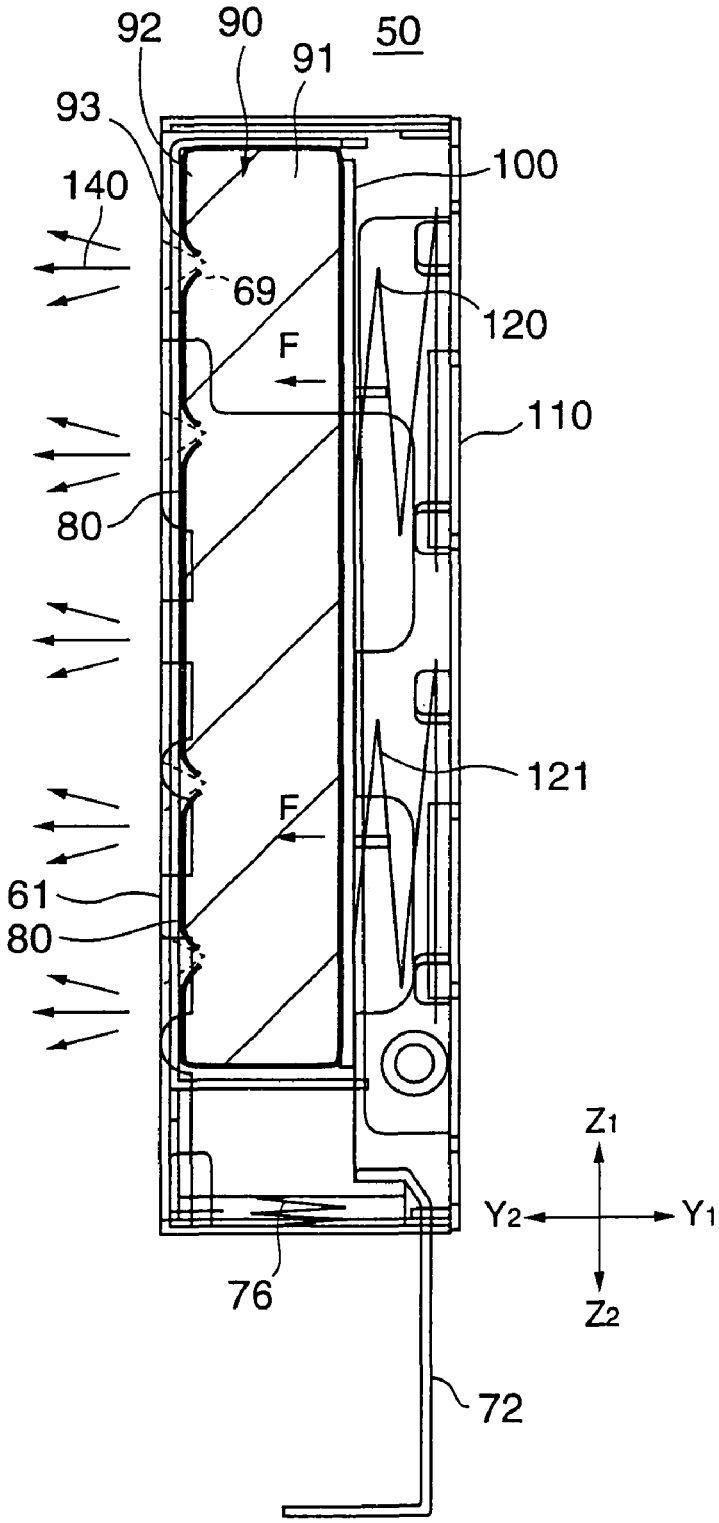
FIG. 8 is a diagram showing a state right after an operation of the theft-prevention ink pack device.

When the support member 70 reaches the position shown in FIG. 7, the support lugs 73*a* and 74*a* are disengaged from the lug portions 85 and 86, and the support lugs 75*a* and 75*b* are disengaged from portions 88 and 89, respectively. Thus, the tray member 80 is released from the support provided by the support member 70, and the tray member 80 together with the ink pack 90 and the pressboard 100 move sharply in the Y2 direction with great force by means of the spring forces F of the conical compression coil springs 120 and 121 until the tray member 80 hits the front board portion 61. In other words, the floor that has been providing support for the ink pack 90 suddenly falls out. FIG. 8 is a diagram showing such state of the theft-prevention ink pack device 50. When the ink pack 90 moves in the Y2 direction, the knife edges 69 end up entering into the window openings 84 of the tray member 80 so that the ink pack 90 closes in on the knife edges 69. Thus, the ink pack 90 hits the knife edges 69 and the bag 92 is torn by the knife edges 69, creating holes 93 therein. As a result, the ink 91 starts shooting out with great force in the Y2 direction as shown by the arrows 140 from the ink spouts 66 of the theft-prevention ink pack device 50.

Since the ink pack 90 is pushed in the Y2 direction by the pressboard 100, the pressboard 100 acts as a piston that applies pressure to the ink pack 90 so that the ink pack 90 is pressed effectively. In this way, practically all of the ink 91 in the bag 92 is dispersed in the Y2 direction at once.

Herein, the pressboard 100 is pushed by the conical compression coil springs 120 and 121 at two different places, and therefore, the movement in the Y2 direction can be stabilized.

Figure 9:
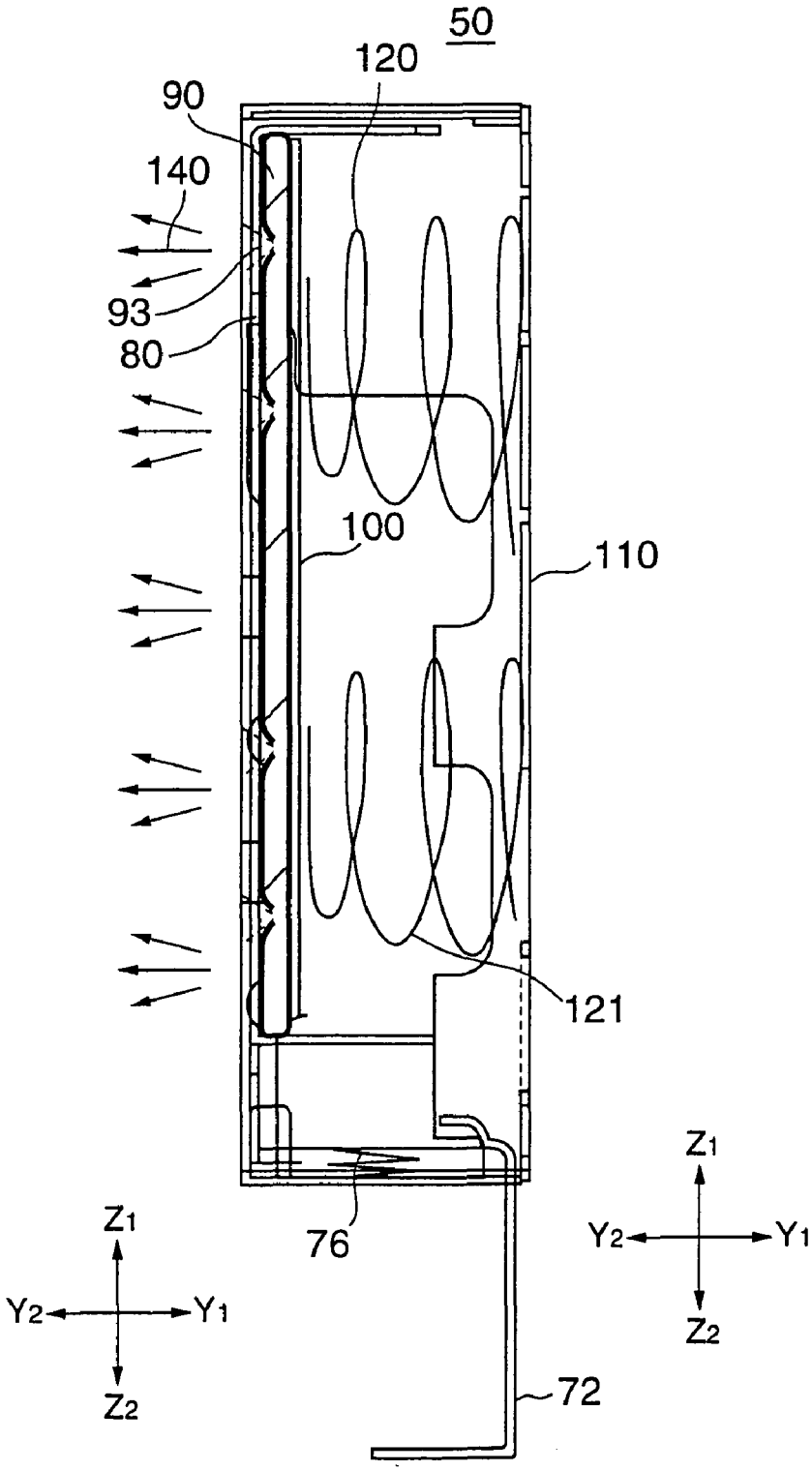
FIG. 9 is a diagram showing a state of the completed operation of the theft-prevention ink pack device.

As described above and as shown in FIG. 9, practically all of the ink 91 in the bag 92 is sprayed from the theft-prevention ink pack device 50 at once with great force in the Y2 direction via the ink spouts 66 by means of the conical compression coil springs 120 and 121. Thus, all of the bank notes 25 kept in the bank note storage room 15 will be tainted by the ink 91 to the extent that they will be worthless as currency.

After the support member is moved in the Z2 direction to activate the theft-prevention ink pack device 50, the support lugs 73*a* and 74*a* will be engaged by the lugs 85 and 86, respectively, of the tray member 80, and the support member 70 will be prevented from moving back in the Y1 direction. Thus, it can be determined whether or not the theft-prevention ink pack device 50 has been used from the position of the arm portion 72.

In the following, features of the theft-prevention ink pack device 50 other than that described above are given.

1. The theft-prevention ink pack device 50 is made into a unit structure.

The ink pack 90 and other components are arranged inside the case 130 so that the theft-prevention ink pack device 50 is arranged into a module or a unit structure. Thus, the cash box 10 can be assembled simply by arranging a structure for connecting the door 12 to the theft-prevention ink pack device 50 and mounting the theft-prevention ink pack device 50 in the cash box 10. In this way, the assembling of the cash box 10 can be simplified and the size of the cash box 10 can be reduced.

2. The cost for fabricating the theft-prevention ink pack device 50 can be reduced.

Since the theft-prevention ink pack device 50 uses no sensor for detecting the start of an operation, no pump for sending ink, no motor for driving the pump, etc., and since neither software nor firmware needs to be implemented, the fabrication cost of the theft-prevention ink pack device 50 can be reduced.

3. The theft-prevention ink pack device 50 has excellent reliability.

The operation of the theft-prevention ink pack device 50 is initiated by the release of the engaged state of its members, and the spraying of the ink is realized entirely by mechanical means using the spring force of the conical compression coil springs 120 and 121. Thus, an electric source is not used in the theft-prevention ink pack device 50, and thereby, problems relating to electric power can be eliminated and the theft-prevention ink pack device 50 is able to operate normally even during a blackout. Also, since the theft-prevention ink pack device 50 does not require software either, problems relating to software can also be eliminated. Thus, high reliability can be realized.

4. The performance of the theft-prevention ink pack device 50 in shooting out ink is improved.

The shooting of the ink 91 is realized using the spring force of the conical compression coil springs 120 and 121, and the ink 91 is shot out at a high speed and dispersed over a wide area. Thus, all the bank notes 25 kept in the bank note storage room 15 can be severely tainted by the ink 91 so that they will be marred to the extent of being invalid as currency.

Also, since the ink 91 is shot out by the spring force of the conical compression coil springs 120 and 121, the theft-prevention ink pack device 50 does not depend upon gravity. Therefore, the theft-prevention ink pack device 50 can be arranged at any position inside the treasure safe such as the cash box 10. That is, the theft-prevention ink pack device 50 is not limited to being implemented under the top board of the treasure safe with the ink spouts 66 facing downward. Rather, the ink 91 can also be effectively sprayed on the bank notes 25 with the ink spouts 66 facing forward from the back side of the safe box as shown in FIG. 1 or with the ink spouts 66 facing upward from the bottom side of the safe box.

In the following, exemplary modifications of the theft-prevention ink pack device 50 will be described.

In one example, the support member 70 and the tray member 80 may be assembled to form a ship-like structure, wherein the ship-like structure is supported so that the bottom of this structure is held away from the knife edges 69. When this structure is moved, it falls into the knife edges 69 so that the ink pack 90 is torn open.

In another example, the ink pack may be fixed to a predetermined position and a board member having a knife edge and an ink spout may be pressured by a spring toward the ink pack. In this configuration, the board member moves to hit the ink pack by means of the spring force when it is disengaged and the ink is shot out as a result.

The invention claimed is:

1. A theft-prevention ink pack device, comprising:

an ink pack, consisting of a bag containing ink, that is placed inside a case having a front board on which an ink spout is formed;

a spring that urges the ink pack and a knife edge to close in on each other, the spring thereby applying pressure to the ink pack;

the knife edge that tears the ink pack, wherein the knife edge is a portion of the front board of the case and is formed by cutting and bending said front board at the rim of the ink spout; and an engaging structure that is engaged to support a state in which the ink pack and the knife edge are spaced apart from each other, and is disengaged when an outer force is applied; wherein:

the ink pack and the knife edge close in on each other by means of a spring force of the spring when the engaging structure is disengaged so that the ink pack is torn by the knife edge, and the ink pack is pressured, resulting in the ink shooting out from the ink spout.

2. The theft-prevention ink pack device as claimed in claim 1, further comprising:

a pressboard positioned at the back side of the ink pack; wherein:

the spring, arranged between the pressboard and a back board of the case, urges the pressboard toward the front board of the case; and the whole ink pack is pressured by the pressboard.

3. The theft-prevention ink pack device as claimed in claim 1, wherein:

the spring is a conical compression coil spring.

4. The theft-prevention ink pack device as claimed in claim 1, further comprising:

a pressboard positioned at the back side of the ink pack; wherein:

a plurality of conical compression coil springs are implemented as the spring, said conical compression coil springs being arranged between the pressboard and a back board of the case and urging the pressboard toward the front board of the case; and the whole ink pack is pressured by the pressboard.

5. A treasure safe comprising:

a box main body in which the theft-prevention ink pack device as claimed in claim 1 is implemented;

a door that opens by being rotated;

a locking device that locks the door and is unlocked upon opening the door;

a connecting structure that connects the door to the theft-prevention ink pack device; and a disconnecting structure for disconnecting the connection made by the connecting structure when the locking device is unlocked.

6. A theft-prevention ink pack device, comprising:

a case including a case main body that is made up of side board portions and a front board portion having an ink spout and a knife edge that is directed inward, and a back lid member that covers the back side of said case main body;

a support member, having a plurality of support lugs, that is slidably arranged on the inner side of the front board portion;

a tray member that is supported by the support lugs in a state of being spaced apart from the knife edge;

an ink pack, consisting of a bag containing ink, that is arranged on the tray member;

a pressboard positioned on the back side of the ink pack; and a spring member arranged between the pressboard and the back lid member in a compressed state; wherein:

the support provided to the tray member by the support lugs is released when the support member is moved, the tray member, the ink pack, and the pressboard are moved to the front board portion by means of the spring force of the spring member, the ink pack is torn by the knife edge, and the ink pack is pressured by the pressboard so that the ink shoots out from the ink spout.

7. A treasure safe comprising:

a box main body in which the theft-prevention ink pack device as claimed in claim 6 is implemented;

a door that opens by being rotated;

a locking device that locks the door and is unlocked upon opening the door;

a connecting structure that connects the door to the theft-prevention ink pack device; and a disconnecting structure for disconnecting the connection made by the connecting structure when the locking device is unlocked.

8. An apparatus comprising:

a main body having a front portion, a back portion and side portions;

a support member slidably arranged in the front portion of the main body and having at least one support lug;

an ink spout provided on an inside of the front portion of the main body to allow ink to be released therethrough;

a knife portion provided on the ink spout and protruding inward in a direction away from the ink spout;

a tray member to be supported by the at least one support lug of the support member;

an ink pack comprising ink therein and arranged in the tray member; and a spring provided near the back portion of the main body, wherein when the support member is moved, the tray member and the ink pack are moved toward the front portion of the main body by a force applied by the spring causing the ink pack to contact with the knife portion and to release ink through the ink spout.

9. The apparatus of claim 8, further comprising:

a pressboard positioned at the back portion of the main body, wherein the spring is arranged between the pressboard and the back portion of the main body and the spring urges the pressboard toward the front portion of the main body and the pressboard applies pressure to the ink pack.

10. The apparatus of claim 8, wherein the knife portion is a part of the front portion of the main body and is formed by cutting and bending the front portion in at a perimeter of the ink spout.

* * * * *